US008074808B2

(12) United States Patent
Fisher

(10) Patent No.: US 8,074,808 B2
(45) Date of Patent: Dec. 13, 2011

(54) AUTOMATED SHELL SEPARATOR

(76) Inventor: Tony A. Fisher, Roanoke, VA (US)

( * ) Notice: Subject to any disclaimer, the term of this patent is extended or adjusted under 35 U.S.C. 154(b) by 866 days.

(21) Appl. No.: 12/156,263

(22) Filed: May 30, 2008

(65) Prior Publication Data

US 2011/0174702 A1 Jul. 21, 2011

(51) Int. Cl.
*B07B 13/00* (2006.01)

(52) U.S. Cl. ..... 209/683; 209/659; 209/664; 209/676

(58) Field of Classification Search ..... 209/659, 209/664, 676, 683, 686, 687
See application file for complete search history.

(56) References Cited

U.S. PATENT DOCUMENTS 2,807,364 A * 9/1957 Suddreth ..... 209/634
3,746,164 A * 7/1973 Culp ..... 209/44
4,141,451 A * 2/1979 Lapointe ..... 209/664
4,541,531 A * 9/1985 Brule ..... 209/664
4,907,702 A * 3/1990 Bielagus ..... 209/664
7,080,741 B1 * 7/2006 Butzin et al. ..... 209/664

* cited by examiner

*Primary Examiner* — Terrell Matthews
(74) *Attorney, Agent, or Firm* — Jeff Seto

(57) ABSTRACT

An automated device that separates out desired shells from a batch of mixed shells. The device allows an operator to gather all spent shells from a shooting range, for example, where many different caliber bullets have been fired, and have all the shells separated by size, or caliber. The preferred embodiment provides for includes a container with adjustable slots in four of the container's sides. An electric motor is also provided that is used to rotated the slotted container. The selected shells fall through the slots into a shell catcher. The sides can be removed and replaced, to adjust the slot size, or container sides with adjustable slots can be provided.

14 Claims, 4 Drawing Sheets

AUTOMATED SHELL SEPARATOR

BACKGROUND OF THE INVENTION

The present invention relates generally to the field of ammunition suppliers and more specifically to a device for separating shell casings by size.

A bullet that is fired out of a pistol or rifle consists of a projectile, a shell casing, or shell, gunpowder and a primer. The gunpowder is contained within the shell, and is ignited by the primer, which is housed in the base of the shell. The pistol, or rifle, includes a hammer and firing pin that is used to strike and ignite the primer. Semi-automatic pistols and rifles are very popular because they automatically eject the shell after the projectile, or round, has been fired. After a busy day at a shooting range, it is not unusual for hundreds of spent shells to be found on the ground. Shells are traditionally made of brass and typically retain their original shape after the bullet has been fired. In order to conserve a natural material and save money, it is common practice in the field to re-use spent shells. Empty shells can be gathered off the floor of an indoor target range, for example, and re-loaded to produce another bullet. Re-loading a shell comprises replacing the primer in the base of the shell, adding the proper amount of gunpowder through the open top of the shell, and seating the projectile in the top of the shell so that a seal is formed. However, bullets come in many different sizes, or caliber, and not all shooters use the same caliber weapon. So, the shells that are gathered off the floor of a shooting range at the end of the day will likely consist of shells of many different sizes. Since a .45 caliber projectile will not fit into the shell for a .22 caliber weapon, the shells must first be sorted by size before re-loading can be begin.

What is needed in the field is an automated device that accepts shells of many different sizes and sorts the shells according to size.

SUMMARY OF THE INVENTION

A device that is adapted to accept shells of many different sizes and separate the shells according to size. The device comprises: a separator housing; an axle, two supports, and a motor. The separator housing comprises multiple elongated sides, a left end, a right end, a housing door, and a housing door latch, wherein the housing door allows access to the interior of the housing. At least one of the elongated sides includes elongated slots, the slots having a width that is approximately equal to one of the shells. The axle is attached to the left and right ends of the separator housing, and includes a left end that extends outside the left end of the separator housing, and a right end that extends outside the right end of the housing. A left side support is rotate-ably attached to the left end of the axle, and a right side support is rotate-ably attached to the right end of the axle. The motor is mechanically attached to the axle, and the motor is able to rotate the axle and the separator housing when the motor is turned on.

In the preferred embodiment, each of the elongated sides of the housing includes elongated slots. A shell catcher that is located below the separator housing is also provided. The shell catcher is able to catch any shell that falls through the slots in the sides of the housing. Further, the motor is preferably an electric motor, and the motor is attached to the axle by a chain. The width of the slots can be changed to a size that is approximately equal to another one of the shells.

The separator housing can take-on different cross-sectional shapes including hexagonal, square and round. The housing, axle and chain are preferably made of metal.

It is an object of the present invention to provide an easy way to separate shells of different sizes, by size.

BRIEF DESCRIPTION OF THE DRAWINGS

The invention of the present application will now be described in more detail with reference to the accompanying drawings, given only by way of example, in which.

DETAILED DESCRIPTION OF THE INVENTION

Figure 1:
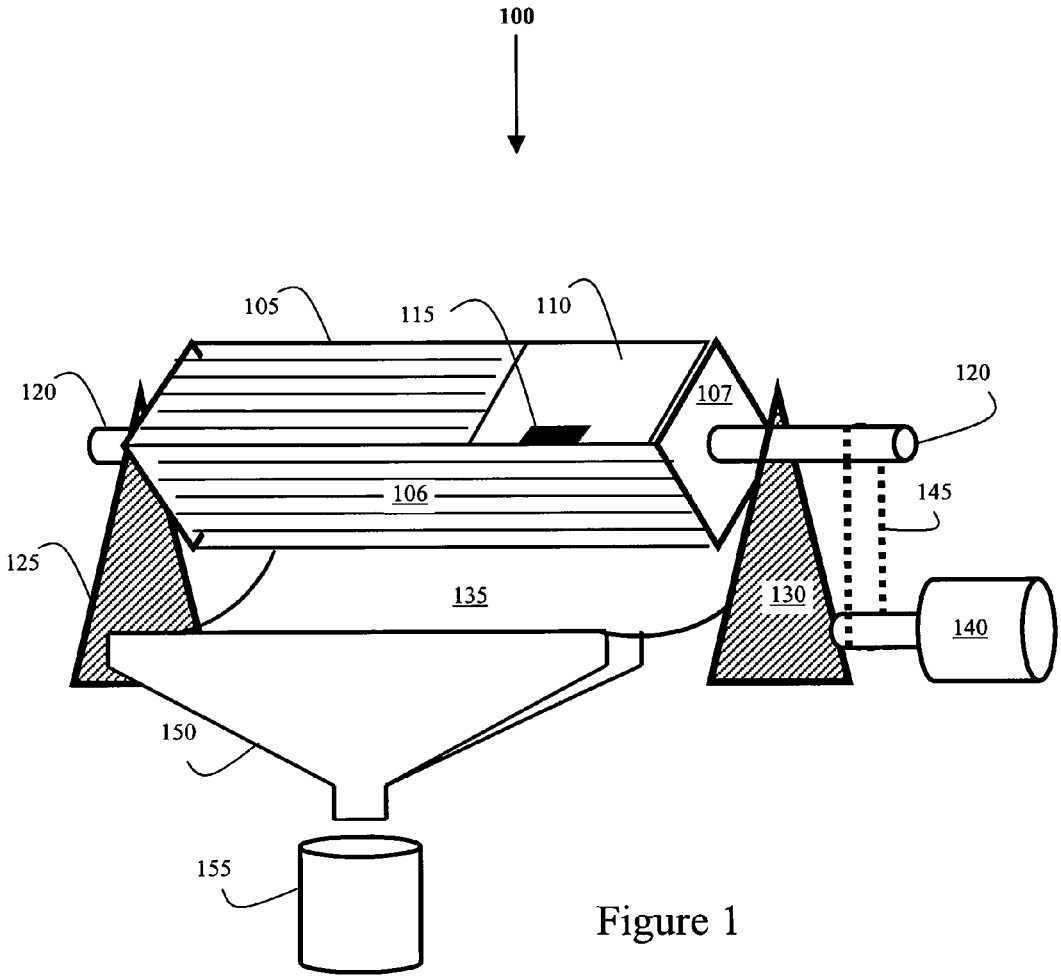
FIG. 1 shows an exemplary embodiment of the present automated shell separator.

FIG. 1 shows an exemplary embodiment 100 of the present automated shell separator, which includes a separator housing 105, an axle 120, end supports 125 & 130 located on opposite sides of the housing, and an electric motor 140 that is mechanically connected to the axle. The separator housing 105 is basically an elongated box. The four elongated sides of housing 105 have adjustable slots 106 in them, which allow shells of a desired size, or caliber, fall through the sides of the housing. A shell catcher 135, at the bottom of the separator 100, is provided to catch the shells that fall through the slots 106. The lower portion of the shell catcher 135 includes a funnel 150 that directs the shells down into a gathering bucket 155. In the preferred embodiment, the each elongated side of the housing comprises two walls, each having matching slots in them. The slot size being approximately equal to the largest shell that will be separated, and the outer wall of each side can be slid to a different position, in order to adjust the size of the slots. In other embodiments of the present shell separator, slot size is adjusted by removing the sides of the housing, and replacing them with sides containing slots of a different size. The elongated sides can be temporarily attached to the housing by any conventional means including, latches, screws, hinges, slots and any combination of these.

Returning to FIG. 1, the electric motor 140 is attached to the axle 120 by a metal chain 145. In the preferred embodiment, the chain 145, axle 120, housing 105, and shell catcher 135 are each made of metal. The axle 120 is rotate-ably attached to the end supports 125 & 130 that are located at opposite ends of the housing 105. The separator housing 105 includes a door 110 and a latch 115 that is used to open and securely close the door 110. In operation, the electric motor 140 is used to rotate the housing 105, via axle 120 and chain 145. As the shells repeatedly fall against the interior walls of the housing 105, the shells are forces against the slots 106. The slots 106 in the sides of the housing 105 are set to a desired size, and shells with the selected size fall down to the shell catcher 135.

Figure 2:
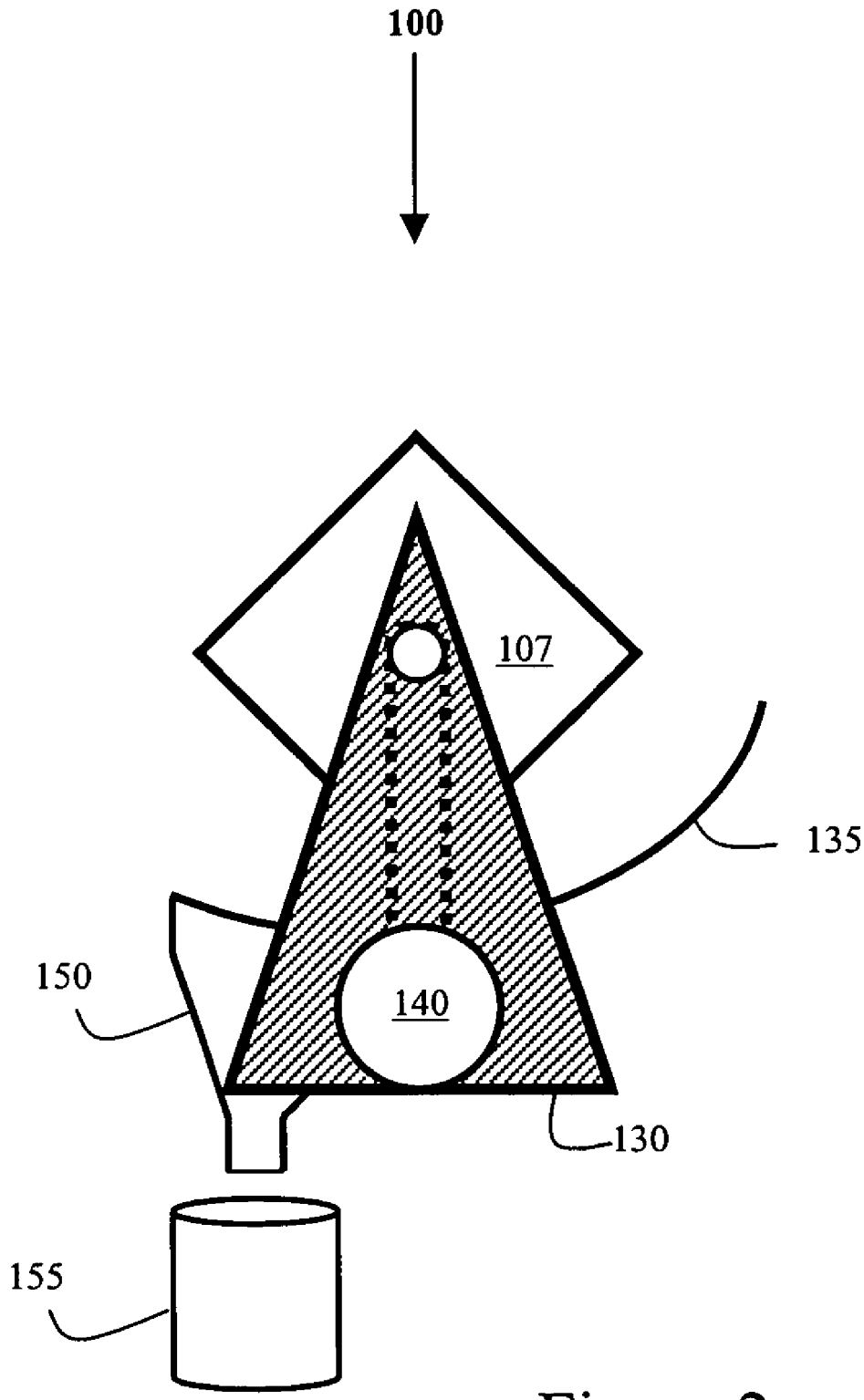
FIG. 2 is a side view of the exemplary embodiment of the present automated shell separator.

FIG. 2 is a side view of the exemplary embodiment 100 of the present automated shell separator. The ends of the housing, including end 107, are intentionally made of a solid sheet, so that no shells fall out of the ends of the housing. The shell catcher 135 is designed to catch all shells that fall out of the separator. The shells are then pulled by gravity down the funnel 150 and into the collection bucket 155.

Figure 3:
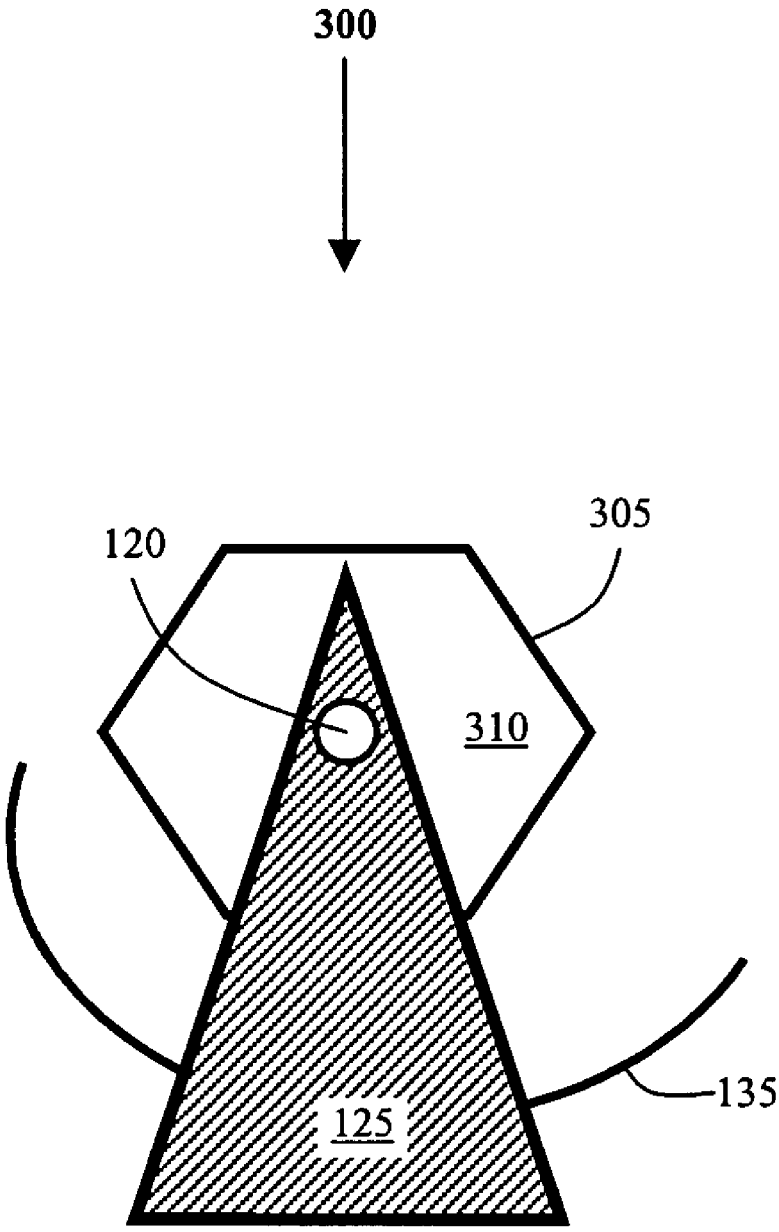
FIG. 3 shows an alternative embodiment 300 of the present automated shell separator; and, FIG. 4 is a flow chart showing exemplary steps for separating shells using the present device.

FIG. 3 shows an alternative embodiment 300 of the present automated shell separator. The housing 305 of the alternative embodiment 300 has a cross-sectional shape that is different from that in the exemplary embodiment, shown in FIGS. 1-2. The housing in the alternative embodiment 300 has a hexagonal cross-section, rather than square. Of course, housings with other cross-section shapes including, round and octagonal, can be used in other embodiments.

Figure 4:
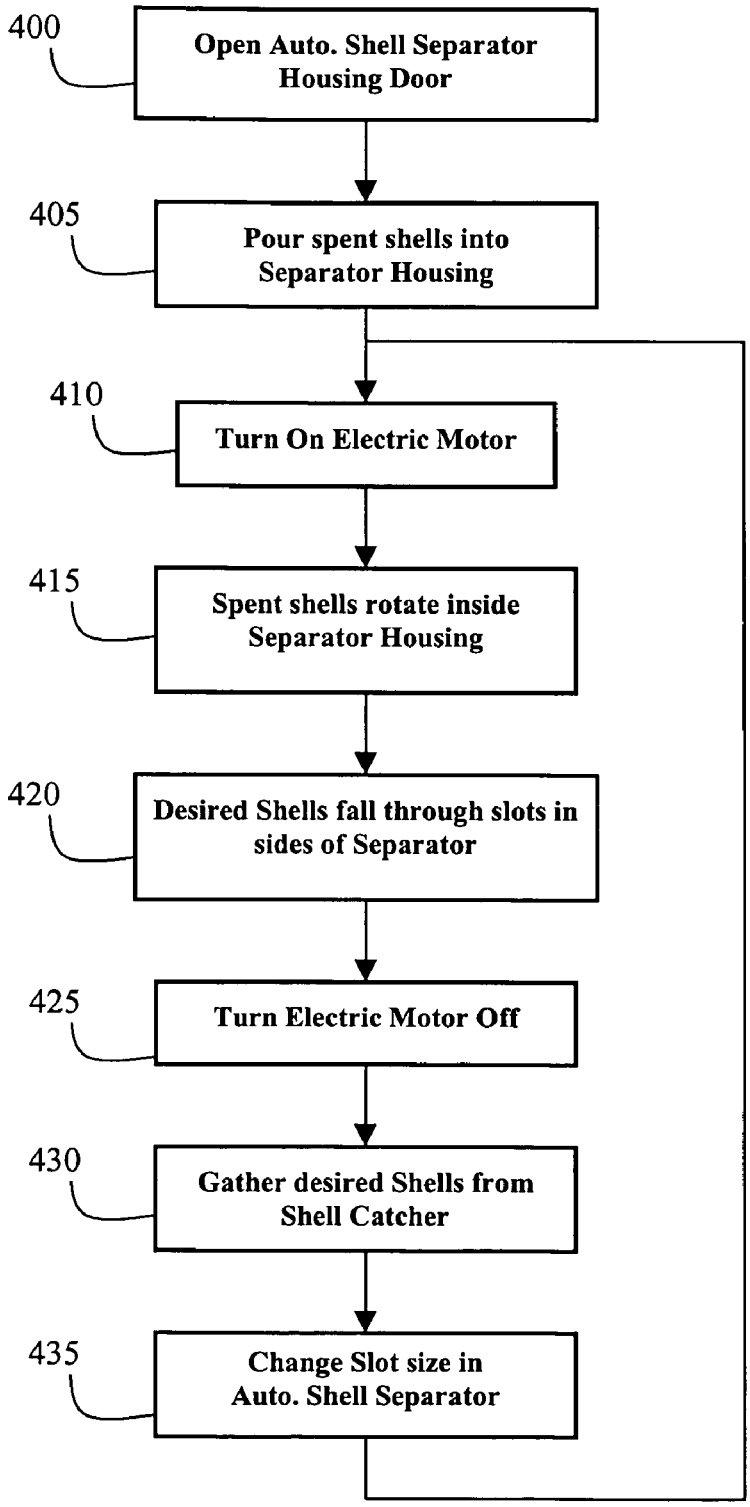

FIG. 4 is a flow chart showing exemplary steps for separating shells using the present device. In step 400, the operator unlatches the housing door. In step 405, the operator pours the shells that have been gathered into the separator housing and latches the door closed. In step 410, the electric motor is turned on, and the housing is rotated. In step 415, the shells within the housing are repeatedly forced against the slotted sides of the housing. In step 420, shells that can fit through the slots in the sides of the housing fall outside the housing and land in the shell catcher. When shells stop falling out of the housing, in step 425, the operator turns the electric motor off. The operator then gathers the shells, which will all be of the same desired size, from the shell catcher, step 430. If other sized shells remain in the housing, in step 435, the operator increases the size of the slots in the sides of the housing and repeats steps 410-430.

The foregoing description of the specific embodiments will so fully reveal the general nature of the invention that others can, by applying current knowledge, readily modify and/or adapt for various applications such specific embodiments without departing from the generic concept. For example, the shell separator can be provided without a motor, and a hand crank can be used to rotate the housing. Therefore, such adaptations and modifications should and are intended to be comprehended within the meaning and range of equivalents of the disclosed embodiments. It is to be understood that the phraseology of terminology employed herein is for the purpose of description and not of limitation.

I claim:

1. A device that is adapted to accept shells of many different sizes and separate the shells according to size, the device comprising:

a separator housing, the housing comprising multiple elongated sides, a left end, a right end, a housing door, and a housing door latch, wherein the housing door allows access to an interior of the separator housing, and further wherein at least one of the elongated sides includes elongated slots, the slots having a width that is approximately equal to one of the shells;

an axle, the axle being attached to the left and right ends of the separator housing, wherein the axle includes a left end that extends outside the left end of the separator housing and a right end that extends outside the right end of the housing;

a left support that is rotate-ably attached to the left end of the axle; and, a right support that is rotate-ably attached to the right end of the axle.

2. The device of claim 1, wherein each of the elongated sides of the housing includes elongated slots.

3. The device of claim 1, further comprising a shell catcher that is located below the separator housing, the shell catcher being able to catch any shell that falls through the slots in the side of the housing.

4. The device of claim 1, further comprising a motor, wherein the motor is mechanically attached to the axle, and wherein the motor is able to rotate the axle and the separator housing when turned on.

5. The device of claim 3, further comprising a funnel that is attached to the shell catcher, wherein the funnel is attached to a lower portion of the shell catcher and the shells are directed down the funnel by gravity.

6. The device of claim 1, wherein the width of the slots can be changed to a size that is approximately equal to another one of the shells.

7. The device of claim 1, wherein the axle extends through the interior of the separator housing.

8. The device of claim 1, wherein the housing has a hexagonal cross-sectional shape.

9. The device of claim 1, wherein the housing has a square cross-sectional shape.

10. The device of claim 1, wherein the housing and the axle are made of metal.

11. The device of claim 4, wherein the motor is attached to the axle by a chain.

12. The device of claim 4, wherein the motor is an electric motor.

13. The device of claim 1, further comprising a gathering bucket, wherein the gathering bucket is located below the funnel and is adapted to catch all shells that fall through a bottom of the funnel.

14. The device of claim 5, wherein the funnel extends across a length of the shell catcher.

* * * * *